United States Patent [19]

Goncalves

[11] Patent Number: 4,909,265

[45] Date of Patent: Mar. 20, 1990

[54] DEVICE FOR THE APPLICATION OF A PRODUCT TO A SURFACE, FOR EXAMPLE, AN APPLICATOR DEVICE FOR A COSMETIC PRODUCT, IN PARTICULAR A DEPILATORY

[75] Inventor: Antonin Goncalves, Montmorency, France

[73] Assignee: L'Oreal, Paris, France

[21] Appl. No.: 238,246

[22] Filed: Aug. 30, 1988

[30] Foreign Application Priority Data

Aug. 31, 1987 [FR] France ..... 87 12072

[51] Int. Cl.[4] ..... A45D 33/00

[52] U.S. Cl. ..... 132/317; 401/219

[58] Field of Search ..... 401/195, 205, 208, 219, 401/220, 236, 237; 132/DIG. 3, 317

[56] References Cited

U.S. PATENT DOCUMENTS 1,258,593 3/1918 Miller ..... 401/236

1,890,599 12/1932 Cobello .

3,008,167 11/1961 Pharris et al. .

FOREIGN PATENT DOCUMENTS 2917805 11/1980 Fed. Rep. of Germany .

3226957 1/1984 Fed. Rep. of Germany .

1346248 11/1963 France .

2574377 6/1986 France .

*Primary Examiner*—James R. Brittain

*Assistant Examiner*—J. Hakomaki

*Attorney, Agent, or Firm*—Cushman, Darby & Cushman

[57] ABSTRACT

The device (1) comprises a container (2) containing the product and a head (7) provided with an applicator (A) constituted by at least one roller (8) mounted on one open end (6) of the container. A valve for obturating the open end (6) is situated inside the head (7) between the open end (6) and the applicator (A). A rotatable knob for actuating the opening and closing of the valve is accessible from outside the head (7).

11 Claims, 3 Drawing Sheets

DEVICE FOR THE APPLICATION OF A PRODUCT TO A SURFACE, FOR EXAMPLE, AN APPLICATOR DEVICE FOR A COSMETIC PRODUCT, IN PARTICULAR A DEPILATORY

The invention relates to a device for applying a product to a surface, notably an applicator device for a cosmetic product, in particular a depilatory, of the kind comprising a container containing the product and a head which is provided with the applicator means, constituted in particular by at least one roller mounted on one open end of the container.

By inclining the container in such a way that the head is turned towards the surface to be covered, the liquid or pastry product, is allowed to flow out towards the applicator means, ensuring the deposit of this product on the surface. Generally a cover or cap is provided to surmount the head and the applicator means when the device is not in use. Storage is effected in the vertical position, the open end facing upwards, while the closed bottom of the container rests on a support, for example a tray or shelf.

The devices of this kind, whilst being fitted with a cap covering the head, are not completely satisfactory as regards the preservation of the product. Moreover, the cleaning of these applicator means generally necessitates their dismantling, because, if a cleaning liquid is used for this operation, this liquid can pollute the product of the container by penetrating into the container open end.

Refilling the container with the product also poses a problem, currently solved in a not entirely satisfactory way by dismantling the head and transferring a quantity of the product from a refill.

Moreover, the known devices are difficult to manipulate with one hand.

The main object of the invention is therefore to provide a device for applying a product to a surface, meeting the various practical requirements better than hitherto and in particular avoiding or mitigating the drawbacks set out above.

Accordingly the present invention provides a device for applying a product to a surface, comprising: a container for the product; and a head provided with applicator means mounted on an open end of the container; wherein said applicator means comprise means inside the head, between said end and the applicator means, for obturating said open end and means accessible from outside the head for actuating the opening and closing of the obturating means; wherein the head is mounted detachably on said open end of the container and the means for actuating the opening and closing of the obturating means are accessible through the wall of the head, said wall comprising at least one window through which a portion of the actuating means projects; wherein the container has, in a plane perpendicular to its longitudinal axis, a cross-section in the shape of a rectangle with rounded corners, or of an oval, and has two large sides of said cross-section; wherein the head comprises two windows one on each of the sides corresponding to said large sides of the container, the actuating means partly passing through these windows; and wherein the means for actuating the opening and closing of the obturating means are constituted by a rotary component mounted for rotation around the longitudinal axis of the container.

The means provided between the first component and the second component for transforming the rotational motion into a translational motion referably comprise a helical ramp or equivalent, provided on the internal cylindrical wall of the first component and capable of cooperating with at least one complementary component, in particular a conjugate pin or rib provided on the external surface of the second component, this latter being stopped from rotating but being free for translation relative to the head of the container by means of grooves or ribs cooperating with the complementary means provided on the end of the container.

The applicator means can be articulated on the head, in particular around a transverse pin situated in the median longitudinal plane of the container. More particularly, the applicator means are mounted in a nose connected to the head by a transverse articulation and traversed by a duct allowing the product coming from the container to pass towards the applicator means. These latter then preferably comprise two parallel rollers mounted for rotation in a receptacle provided on the nose.

Apart from the features set out above, the invention embraces several other characteristics which will be discussed in greater detail below, merely by way of example, with reference to some particular embodiments described with reference to the accompanying drawings, in which.

Figure 1:
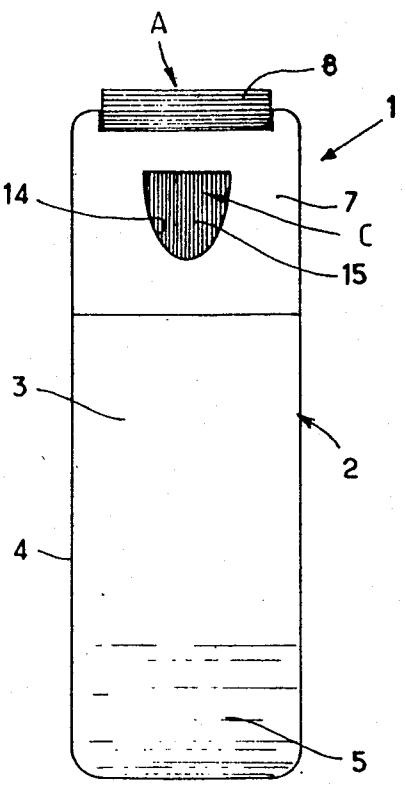
FIG. 1 is an elevational view of an applicator device in accordance with the invention.
Figure 2:
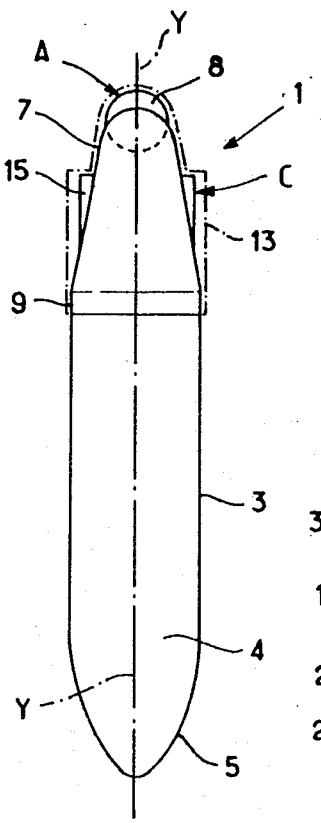
FIG. 2 is a view from the left of FIG. 1.

Referring now to the drawings, and in particular to FIGS. 1 to 4, a device 1 can be seen for applying a liquid or pasty product to a surface. More particularly, the device 1 is an applicator device for a cosmetic product, notably a depilatory product to be applied to the skin.

This device 1 comprises a container 2, generally constituted by a bottle made of a relatively deformable material, in particular a flexible plastic material. By tightly gripping the sides of the bottle in one hand, it is possible to produce a deformation of these sides and an increase in the internal pressure promoting the outflow of the product.

The container 2 has an overall parallelepiped shape with two large lateral rectangular faces such as 3, joined by two narrow faces, such as 4. The bottom 5 of the container 2, viewed in profile (FIG. 2), is ogival. The end 6 (see FIGS. 3 and 4) of the container 2 remote from the bottom 5, is open. In the drawings, this open end 6 is situated at the upper portion of the container.

A head 7, provided with applicator means A constituted by a roller 8, is mounted on the open end 6. This head 7 has substantially the shape of a truncated prism whose base 9 comprises an internal bead catch-engaged in a groove 11 in the external surface of the wall of the container 2. The head 7 surmounts the whole upper portion of the container 2, the open end 6 being situated inside this head.

As may be seen in FIG. 1, the roller 8 extends along the major portion of the width of the head 7, and is mounted for rotation around a transverse geometrical axis 12, situated in the median plane of the container 2.

A cap 13 (FIG. 2) is provided for covering the applicator means A when the device is not in use. When in position, this cap 13 completely surrounds the head 7 which it comes to grip around the base 9.

The applicator device 1 comprises, moreover, means F for obturating the open end 6, these means F being situated inside the head 7 between the end 6 and the applicator means A. There are also means C for actuating the opening and closing of the obturating means F and which are accessible from the outside through a window such as 14, provided respectively on either side of the head 7 on the large lateral slanting side of this head.

Figure 3:
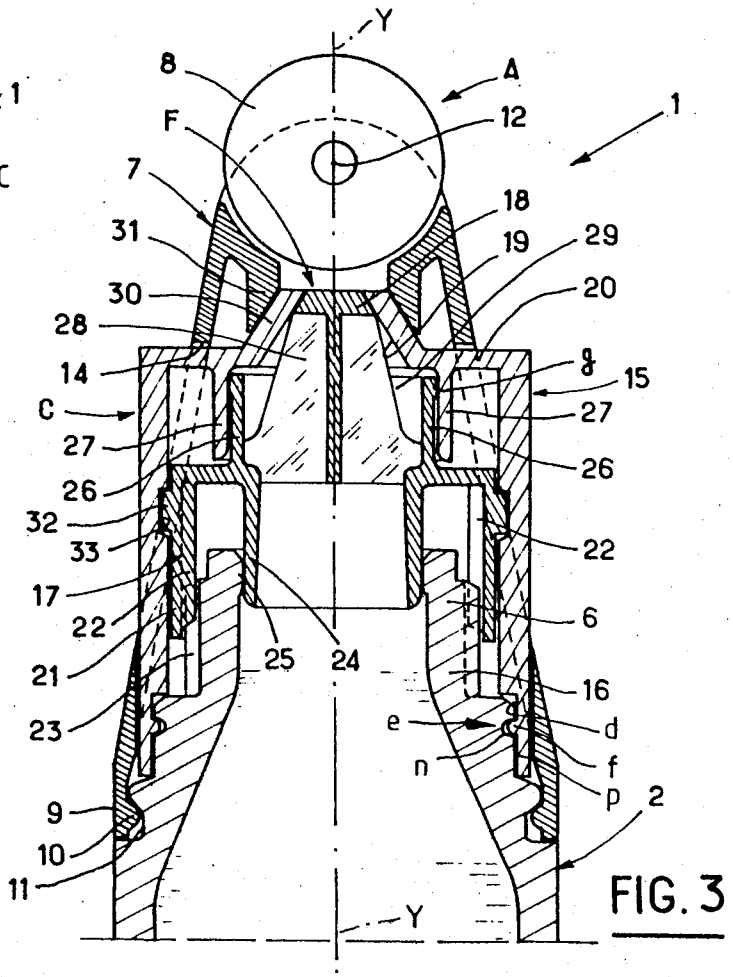
FIG. 3 is a transverse cross-sectional view, on an enlarged scale, of the top portion of the device of FIGS. 1 and 2 with the obturating means in the closed position.
Figure 4:
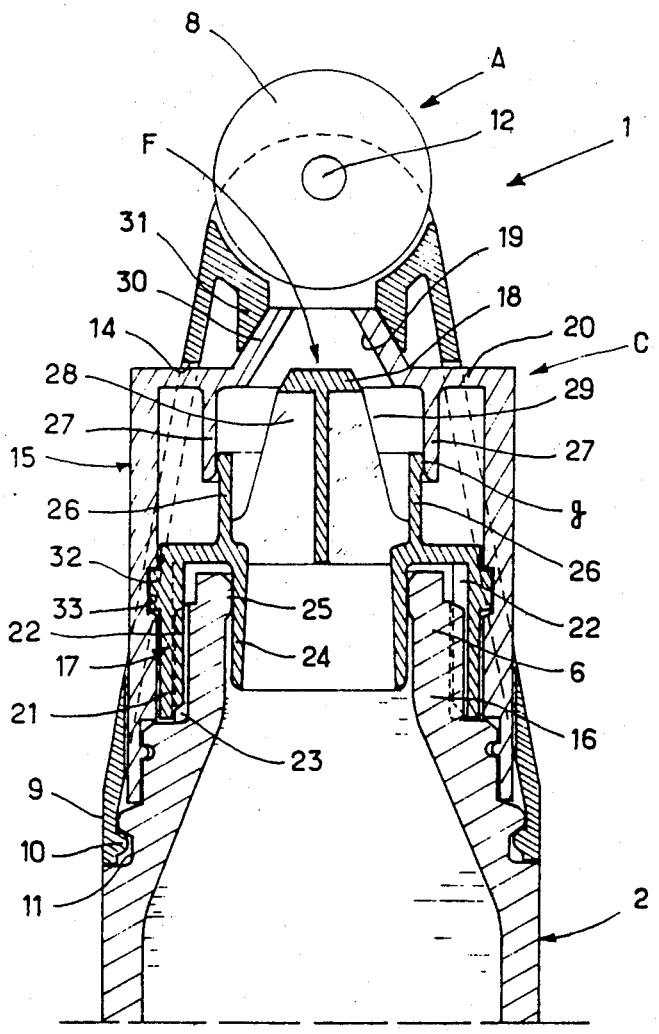
FIG. 4 is a view similar to FIG. 3 but showing the obturating means in the open position.

The actuating means C are advantageously constituted by a knurled part 15 mounted for rotation around the axis Y—Y of the container, on an external wall of the end 6 having the shape of a cylindrical neck 16. The lateral wall of the knurled part 15 is a cylinder of revolution and can be provided with striations orientated along the generatrices, as may be seen in FIG. 1. The lower portion of the internal cylindrical surface of the knurled part 15 has a cylindrical set back d (FIG. 3) of reduced thickness, centred on a cylindrical bearing surface p of the neck of the container 2. On the internal surface of the set back d and on the external surface of the bearing surface p, are catch engagement means e capable of stopping the knurled part 15 from translation in relation to the container 2 whilst leaving it free to rotate. In the embodiment of FIGS. 3 and 4, the catch engagement means e comprises (a) a peripheral bead 1 provided on the set back d and projecting radially inwardly and (b) a corresponding groove n on the surface of the bearing surface p. Window 14 is delimited towards the top by a straight transverse edge and towards the bottom by a semi-elliptical contour.

As may be clearly seen in FIGS. 3 and 4, the obturating means F comprise two components one of which is constituted by the knurled part 15, whilst the other component 17 is stopped from rotating but is capable of displacement in translation parallel to the direction of the axis Y—Y, relative to the container 2.

This second component 17 is situtated inside the knurled part 15 and comprises a stopper peg 18 capable of closing an opening 19 in the upper transverse wall 20 of the knurled part 15.

The component 17 comprises an external cylindrical skirt 21, situated against the internal wall of the knurled part 15. This skirt 21 comprises on its internal surface, ribs 22 orientated parallel to the generatrices and regularly distributed over the whole skirt circumference; these ribs 22 are capable of engagement in conjugate grooves 23 provided on the external surface of the neck 16. It is the cooperation of the ribs 22 and of the grooves 23 which prevents the component 17 from rotating relative to the container 2 whilst leaving it free for translation along a direction parallel to the Y—Y axis.

The component 17 moreover comprises an internal skirt 24 whose external surface can slide in a leak-proof manner against the internal surface 25 of the opening of the end 6.

The component 21 comprises another cylindrical skirt 26 at the end remote from the skirt 24 and having an external surface provided with an external bead g capable of sliding in a leak-proof manner against the internal surface of a skirt 27 fixed to the transverse wall 20 of the knurled part 15.

The stopper peg 18 projects upwardly beyond the end of the skirt 26 remote from the container 2; this stopper peg 18 is carried by planar walls 28, so that openings 29 are formed between the stopper peg 18 and the skirt 26. The external lateral surface of the stopper peg 18 has a frustoconical shape and is capable of being applied in a leak-proof manner against the internal conjugate surface of the opening 19, as may be seen in FIG. 3.

The opening 19 is delimited by a frustoconical end fitting 30 integral with the wall 20 and projecting from the end of this wall remote from the container 2.

The head 7 is provided with an internal base 31 with a frustoconical surface which becomes applied in a leak-proof manner against the external surface of the end fitting 30.

The component 17 comprises on its external cylindrical surface a projecting helical ramp 32 capable of cooperating with a conjugate helical groove 33 in the internal surface of the knurled part 15. It will be immediately understood that by rotating the knurled part 15 in the appropriate direction, one can either close the obturating means F by bringing the stopper peg 18 against the wall 19, as shown in FIG. 3, or open them by moving this stopper peg 18 away from the wall 19, causing the component 17 to retract to the FIG. 4 position which represents the open position of the obturating means.

The operation and use of the applicator device of FIGS. 1 to 4 follow directly from the preceding explanations.

When the product contained in the container 2 is to be applied to a surface, the areas parts of the knurled part 15 accessible from outside are engaged through the windows 14 (see FIG. 1) to rotate this knurled part 15 in the appropriate direction to retract the stopper peg 18 relative to the opening 19 in order to open the passage for the product. The maximum opening is obtained when the component 17 has been retracted to the maximum extent as shown in FIG. 4.

If the bottle 2 is then grasped and inclined in such a way that the roller 8 can bear on the surface to be coated as it rolls, the product to be applied can reach the roller 8. Exerting a pressure of various magnitudes on the faces 3 of the bottle enables the flow of the product applied to be adjusted.

When the application of the product has been completed, the knurled part 15 is urged in the opposite direction so that the stopper peg 18 comes to abut the frustoconical surface of the opening 19 as shown in FIG. 3. The container, 2 is then closed in a leak-proof manner, and the product can be perfectly preserved. In this closed position of the container, it is possible to clean the head 7 and, more particularly, the roller 8 and the portion carrying this roller, for example by rinsing with an appropriate liquid without the risk of contaminating the product in the container 2 by the cleaning liquid.

The unit comprising the container 2 and the obturating means F can be stored in the form of a refill bottle on which the applicator head 7 can be fitted.

The unit is rational in use since the opening and the closing are actuated by a simple movement. The unit is also constituted by only a small number of parts.

Figure 7:
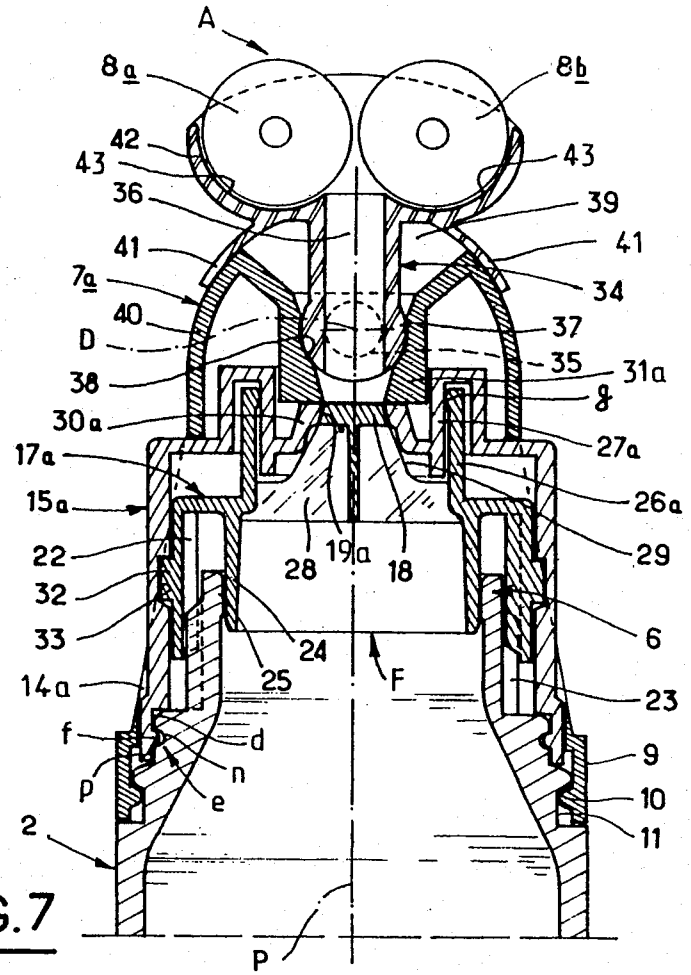
FIG. 7 is a transverse cross-section, on an enlarged scale, of the upper portion of the device of FIG. 5 with the obturating means represented in the closed position.
Figure 6:
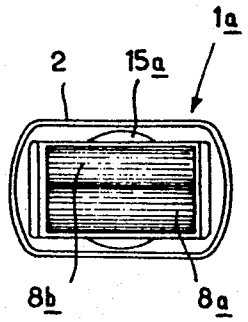
FIG. 6 is a top plan view of the embodiment of FIG. 5.
Figure 5:
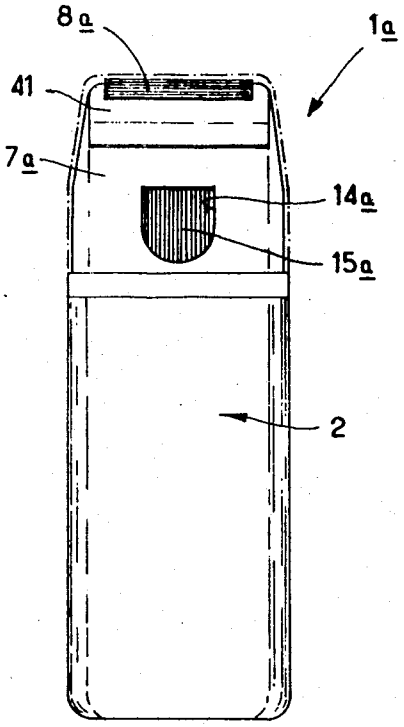
FIG. 5 is an elevational view of a variant of the embodiment of FIGS. 1 to 4.

FIGS. 5 to 7 show a variant of the embodiment of FIGS. 1 to 4; those elements similar to, or performing functions analogous to, the elements already described with reference to the preceding Figures are designated by the same reference numerals possibly followed by the letter a or b. The description of these elements will not be repeated or will be repeated only succinctly.

The main difference between the device of FIGS. 5 to 7 and that of FIGS. 1 to 4 lies in the articulation in FIGS. 5 to 7 of the applicator means A on the head 7*a* around a transverse geometrical axis D situated in the median longitudinal plane P of the container 2.

More particularly, the applicator means A are mounted on a nose 34 joined to the head 7*a* by a transverse articulation 35. The nose 34 is traversed by a longitudinal duct 36 allowing the product from the container to pass towards the applicator means A. The end of the nose 34 facing the container comprises, on its external surface, a cylindrical bulge which is catch-engaged in a conjugate concave cylindrical recess 38 in the base 31*a* of the head 7*a*. The articulation of the nose 34 on the head 7*a* is effected in a leak-proof manner.

The lower transverse wall of the base 31*a* is applied in a leak-proof manner against the transverse end wall of the end fitting 30*a*.

The upper portion of the head 7*a* a comprises a dihedron-shaped cut out 39 flaring outwardly to allow the angular deflection of the nose 34 and of the applicator means A. On either side of this cut out 39 the head 7*a* comprises a cylindrical wall 40 centred on the axis D, against which wall there may slide a conjugate cylindrical wall 41 of the nose 34 which keeps the cut out 39 closed irrespective of the angular orientation of the nose 34.

It may be observed that in the variant of FIGS. 5 to 7 the skirt 26*a* of the component 17*a* externally surrounds the skirt 27*a* of the knurled part 15*a*. The skirt 26*a* is in leak-proof contact with the external surface of the skirt 27*a* by means of an internal peripheral bulge g similar to the external bulge provided in FIGS. 1 to 4.

Parts of the knurled part 15*a* are accessible through the windows 14*a* provided in the walls of the head 7*a*. These windows 14*a* have a slightly different shape from those of the windows 14 of FIGS. 1 and 2, as may be seen in FIG. 5. Preferably the end of the nose 34 which is remote from the container 2 is in the form of a receptacle 42 comprising on either side of the median plane P, a part-cylindrical cavity 43 capable of receiving a respective rotatable roller 8*a* or 8*b*. The axes of these two rollers 8*a* and 8*b* are parallel to the transverse axis D. The plane of the axes of the two rollers 8*a*, 8*b* when they occupy their median position represented in FIG. 7 is orthogonal to the plane P.

The functioning of the device of FIGS. 5 to 7 is similar to that of FIGS. 1 to 4. Opening or closing of the obturating means F is effected by operating the knurled part 15*a* to cause it to rotate. When the stopper peg 18 is applied against the opening 19*a*, as represened in FIG. 7, the obturating means are closed. Opening is obtained by causing the stopper peg 18 to retract relative to the opening 19*a*.

The articulation of the nose 34 in the head 7*a* improves the conditions under which the product is applied to the surface since it allows the roller to follow the contours of this surface precisely, with a certain degree of freedom in relation to the position of the container 2.

All the advantages obtained with the embodiment of FIGS. 1 to 4 are retained with this variant.

With both variants, the roller carrier head 7 or 7*a* is detachable by disengaging the bead 10 from the groove 11 by means of a slight twisting movement.

I claim:

1. A device for applying a product to a surface, comprising: a container for the product, said container having a longitudinal axis; a head having a wall and provided with applicator means with said head detachably mounted on an open end of the container; wherein said applicator means comprises means inside said head, between said end and the applicator means, for obturating said open end and means for actuating the opening and closing of the obturating means; wherein the means for actuating the opening and closing of said obturating means are accessible through a pair of windows provided in the wall of the head with said means for actuating projecting at least partially through said windows; wherein the container has two large sides extending substantially parallel to the longitudinal axis of the container; wherein said windows are disposed one in each of said sides; and wherein said means for actuating the opening and closing of said obturating means comprise a rotary component mounted for rotation around said longitudinal axis of the container.

2. A device according to claim 1, wherein said rotary component of the means actuating opening and closing of the container is knurled.

3. A device according to claim 1 or 2, wherein the applicator means comprise at least one applicator roller.

4. A device according to any one of claim 2, wherein said obturating means comprise two components, one of which is secured against translation and is rotatable relative to the container and is mounted directly on said open end of the container, whilst the other said component is placed inside the first component and is secured against rotation relative to the container but can be displaced axially in relation to the container, said other component comprising a stopper peg capable of translation to obturate an opening in the first component so as to close the open end of the container; wherein means are provided between the first and second components for transforming the rotational movement of the first component into a translational movement of the second component; and wherein said first component constitutes the means for actuating the opening and closing of the obturating means.

5. A device according to claim 4, wherein the means provided between the first and second components for transforming the rotational movement into a translational movement comprise a helical ramp provided on a cylindrical inner wall of the first component and capable of cooperating with complementary means on the external surface of the second component, said second component being stopped from rotation but free for translation in relation to the head of the container by means of ribs cooperating with complementary means on the open end of the container.

6. A device according to any one of claim 5, wherein the applicator means are articulated on the head.

7. A device according to claim 6, wherein the axis of articulation is a transverse axis in the median longitudinal plane of the container.

8. A device according to claim 7, wherein the applicator means are mounted in a nose joined to the head by a transverse articulation and traversed by a duct allowing the product coming from the container to pass towards the applicator means.

9. A device according to claim 8, wherein the applicator means comprise two rollers mounted for rotation in a receptacle provided on the nose.

10. The apparatus as claimed in claim 1 in which the container contains a cosmetic product.

11. A device according to claim 10, wherein said cosmetic product is a depilatory.

* * * * *